US010981075B2

(12) United States Patent
Bellon

(10) Patent No.: US 10,981,075 B2
(45) Date of Patent: Apr. 20, 2021

(54) ACTION FIGURE

(71) Applicant: Michael Bellon, San Diego, CA (US)

(72) Inventor: Michael Bellon, San Diego, CA (US)

( * ) Notice: Subject to any disclaimer, the term of this patent is extended or adjusted under 35 U.S.C. 154(b) by 0 days.

(21) Appl. No.: 16/241,819

(22) Filed: Jan. 7, 2019

(65) Prior Publication Data

US 2019/0344189 A1 Nov. 14, 2019

Related U.S. Application Data

(63) Continuation of application No. PCT/US2017/040985, filed on Jul. 6, 2017.

(60) Provisional application No. 62/359,010, filed on Jul. 6, 2016.

(51) Int. Cl.
*A63H 13/04* (2006.01)
*A63H 3/20* (2006.01)
*A63H 31/00* (2006.01)

(52) U.S. Cl.
CPC ..... *A63H 13/04* (2013.01); *A63H 3/20* (2013.01); *A63H 31/00* (2013.01)

(58) Field of Classification Search
CPC ..... A63H 13/04; A63H 13/06; A63H 13/08; A63H 13/12; A63H 13/14; A63H 3/20; A63H 31/00
USPC ..... 446/303, 330, 331, 333, 334, 335, 336, 446/352, 354, 359, 366, 367
See application file for complete search history.

(56) References Cited

U.S. PATENT DOCUMENTS 4,186,518 A 2/1980 Luke
4,457,097 A * 7/1984 Miller ..... A63H 3/48 446/327
4,605,382 A * 8/1986 Cook ..... A63H 3/20 446/330
4,657,518 A * 4/1987 Kelley ..... A63H 3/48 185/39
4,702,122 A * 10/1987 Richard ..... F16D 7/021 192/56.1
4,802,878 A * 2/1989 Terzian ..... A63H 3/48 446/300
4,878,880 A * 11/1989 Williams ..... F16D 7/048 464/37
4,968,280 A * 11/1990 Kelley ..... A63H 3/20 446/330
5,000,721 A * 3/1991 Williams ..... F16D 7/048 192/46
5,073,138 A * 12/1991 Klitsner ..... A63H 31/00 446/103
5,150,851 A * 9/1992 Manusch ..... B65H 37/007 242/599.4

(Continued)

OTHER PUBLICATIONS

International Searching Authority, International Search Report and Written Opinion for International Application No. PCT/US2017/040985, dated Sep. 7, 2017, 10 pages.

*Primary Examiner* — Joseph B Baldori

(74) *Attorney, Agent, or Firm* — David R. Heckadon; Gordon Rees Scully Mansukhani LLP

(57) ABSTRACT

The disclosure herein relates to dolls and action figures that are capable of lifelike movement via a manual controller. In some embodiments, only the movement of the arms or legs is manually controlled. In another embodiment, the movement of both the arms and legs is manually controlled. In some embodiments, the actuator gearing system includes a clutch to help prevent the gears from stripping. In other embodiments, the controller is removable.

19 Claims, 21 Drawing Sheets

(56) References Cited

U.S. PATENT DOCUMENTS 5,158,492 A * 10/1992 Rudell ..... A63H 3/48 446/175
5,601,491 A * 2/1997 Chan ..... F16D 7/048 192/56.1
6,126,508 A * 10/2000 Chou ..... A63H 3/20 446/352
6,224,456 B1 * 5/2001 Wittenberg ..... A63H 3/20 446/330
6,939,196 B2 * 9/2005 Bellon ..... A63J 19/006 446/239
7,255,625 B2 * 8/2007 Bellon ..... A63J 19/006 446/239
7,338,341 B2 * 3/2008 Hoeting ..... A63H 13/02 446/268
7,338,342 B2 * 3/2008 Bellon ..... A63H 3/20 446/239
7,517,271 B1 4/2009 Alfaro
7,621,815 B2 * 11/2009 Bosserdet, Jr. ..... F16D 7/048 464/37
8,043,138 B2 * 10/2011 Buckley ..... A63H 3/50 446/280
8,550,449 B2 * 10/2013 Vicente, Jr. ..... F16D 41/12 271/109
8,556,675 B2 * 10/2013 Gonzalez ..... A63H 27/10 446/220
8,668,545 B2 * 3/2014 Schnuckle ..... A63H 13/02 446/330
10,024,367 B2 * 7/2018 Kim ..... F16D 7/048
10,344,805 B1 * 7/2019 Strauss ..... F16D 7/048
10,621,896 B2 * 4/2020 Kasuga ..... A63H 3/20
2005/0136791 A1 * 6/2005 Bellon ..... A63J 19/006 446/327
2005/0287907 A1 * 12/2005 Bellon ..... A63J 19/006 446/135
2006/0160466 A1 7/2006 Bellon
2006/0292965 A1 12/2006 Strauss
2009/0149109 A1 6/2009 Yoneda et al.
2011/0086571 A1 * 4/2011 O'Hare ..... A63H 3/46 446/330
2014/0329434 A1 * 11/2014 Saunders ..... A63H 3/20 446/330
2019/0344189 A1 * 11/2019 Bellon ..... A63H 3/20

* cited by examiner

ACTION FIGURE

CROSS REFERENCE TO RELATED APPLICATIONS

This Application is a Continuation of International Patent Application No. PCT/US2017/040985 filed on Jul. 6, 2017, which claims the benefit of U.S. Provisional Application No. 62/359,010, filed on Jul. 6, 2016, the entire contents of which are incorporated by reference in their entirety herein.

TECHNICAL FIELD disclosure herein relates to dolls and action figures that are capable of lifelike movement via a manual controller. In some embodiments, only the movement of the arms or legs is manually controlled. In another embodiment, the movement of both the arms and legs is manually controlled. In some embodiments, the actuator gearing system includes a clutch to help prevent the gears from stripping. In other embodiments, the controller is removable.

BACKGROUND

For generations, kids, teens, and adults have played with dolls or action figures. Most dolls are motionless and require manual manipulation to move the doll or action figure into specific configurations, e.g. sitting or standing. With advancements in photography and videography, more kids, teens, and adults are making movies of their dolls or action figures. With most dolls or action figures, this requires "stop-motion" type filming that can take hours to make short videos. Accordingly, there is a need for dolls and action figures that allow for more lifelike movement without having to manually adjust the parts of the doll or action figure.

SUMMARY

The following simplified summary provides a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented below.

The disclosure herein is directed to a controller that allows a user to manipulate the movement of an action figure or doll (herein collectively referred to as "doll"). The controller uses a series of actuators and gears to affect the doll's movement, in particular, the movement of the arms and/or legs. The user engages the actuators and gears by moving buttons on the controller. In general, the controller is set up such that the buttons on the right side of the controller control movement of the right side of the doll whereas the buttons on the left side of the controller control movement of the left side of the doll. The controller can be used with one hand or with both hands. The general layout of the controller can be scaled to fit dolls of different sizes.

In one embodiment, the controller includes, a handle, a shaft, at least two buttons, at least two actuators, and a gear box. In one embodiment, the handle is generally knob-like in shape, however, other shapes are also contemplated. In one embodiment, the shaft is generally hollow and cylindrical in shape, however, other shapes are also contemplated. The handle is attached to the shaft at one end and the gear box is attached at the opposing end. On the outside of the shaft are at least two buttons. The buttons generally move in a linear fashion along the longitudinal axis of the shaft. In one embodiment, the buttons are located on opposing sides of the shaft. Each button maybe roughly half doughnut-like in shape, however other shapes are also contemplated. When aligned, the buttons form a doughnut-like shape with the shaft running through the center. Inside the shaft are at least two actuators. The actuators are attached to the buttons at one end and have a gear mesh section at the opposing end. The actuators attach to the buttons through holes in the side of the shaft. The hole must be long enough to allow the actuator to move up and down in conjunction with the movement of the button. In one embodiment, the gear mesh section is comb-like in shape, however other shapes are also contemplated. The gear mesh section of each actuator engages or meshes with at least one gear in the gear box. Generally, the gear box has two sets of gears, one for the right half of the doll and one for the left half of the doll. In some embodiments, each set of gears includes at least two gears and another actuator. In other embodiments, each set of gears includes at least three gears and another actuator. In yet another embodiment, each set of gears includes at least four gears and another actuator. At least one gear in each set of gears is attached to another actuator. This actuator actuates the movement of the arm or leg that it is connected to. Thus, when the user moves the button on the controller, the actuator moves and engages a first gear. The first gear in turn engages a second gear that is in turn connected to another actuator. Movement of the second gear results in movement of the arm or leg. The end result is the controlled movement of the arm or leg through the buttons on the controller.

In some embodiments, additional gears can be used to help with spacing and/or to increase the range of motion of the arm and/or leg movement. For example, two thinner gears stacked together could be used in place of one thicker gear. Or a smaller gear could be stacked on top of a larger gear. Generally when gears are stacked, they should move as one unit. In another embodiment, additional gears could be used for clutch-like a purpose, that is to allow the gears to slip passed each other to prevent damage or stripping of the gears. For example if the user moved the arm or leg under force. In these embodiments, the gears may also be modified to give the gears more flexibility to slip past each other. For example, the gears may have gaps in the cogs or open spaces. The number of gaps or open spaces may vary. In embodiments have more than one gap or open space, the gaps or open spaces should be distributed equidistant along the circumference of the gear. Alternatively, the gear may be an internal gear, i.e., having the teeth, cogs, spurs, etc. on the inside of the cylindrical shape. Or both modified and internal gears may be use.

In another embodiment, the controller as described above may further include another set of buttons, actuators, and gear box. In this embodiment, the first set of buttons, actuators and gear box control either the arms or legs and the second set controls the other. For example, if the first set controls the arms than the second set control the legs. The second set of buttons, actuators, and gear box are set up similarly to the set described above.

In general, the gear boxes are located within the torso portion of the doll. The gear box controlling the legs may be located in the lower torso whereas the gear box controlling the arms may be located in the upper torso.

In another embodiment, the controller may be detached and re-attached to the doll. In one embodiments, the point of detachment is above the gear box(es) such that the gear box(es) remain with the doll. In this embodiment, a locking and/or guiding system may be needed to ensure that the actuators are functional after detachment and re-attachment. For example, the actuators could use male to female coupling. Alternatively, the actuator could remain intact and be pulled out with the detached portion of the controller. In another embodiment, the entire controller, including the gear boxes may be detached. In this embodiment, a locking and/or guiding system may need to be used to ensure that the arm and leg actuators are properly fitted when the controller is re-attached.

DETAILED DESCRIPTION

The disclosure herein is directed to action figures or dolls (herein collectively referred to as "doll" or "dolls") that are moveable through the use of a manually manipulated controller. Similar toy manipulators have been described in U.S. Pat. Nos. 6,939,196; 7,255,625; and 7,338,342, all entitled "Omnidirectional Toy Manipulator," the content of all are incorporated by reference herein. The controller allows the user to move the doll in a life-like manner. Through the controller, the user can independently move each leg and each arm as well as rotate the torso. The controller extends from the back of the doll such that movement of the doll can occur without the hands covering any part of the body of the doll. In some embodiments, the gearing includes a clutch to prevent gears from stripping during forceful movements. In other embodiments, the controller is removable, returning the doll to a standard doll. The ability to manipulate the dolls introduces a dynamic range of activities for the dolls and encourages imaginative play. Additionally, these dolls help develop hand eye coordination and fine motor skills.

When the terms "one," "a," or "an" are used in this disclosure, they mean "at least one" or "one or more," unless otherwise indicated.

The terms "invention" or "present invention" as used herein are intended to be non-limiting and are not intended to refer to any single embodiment of the particular invention but encompasses all possible embodiments as described in the specification and the claims.

Figure 1:
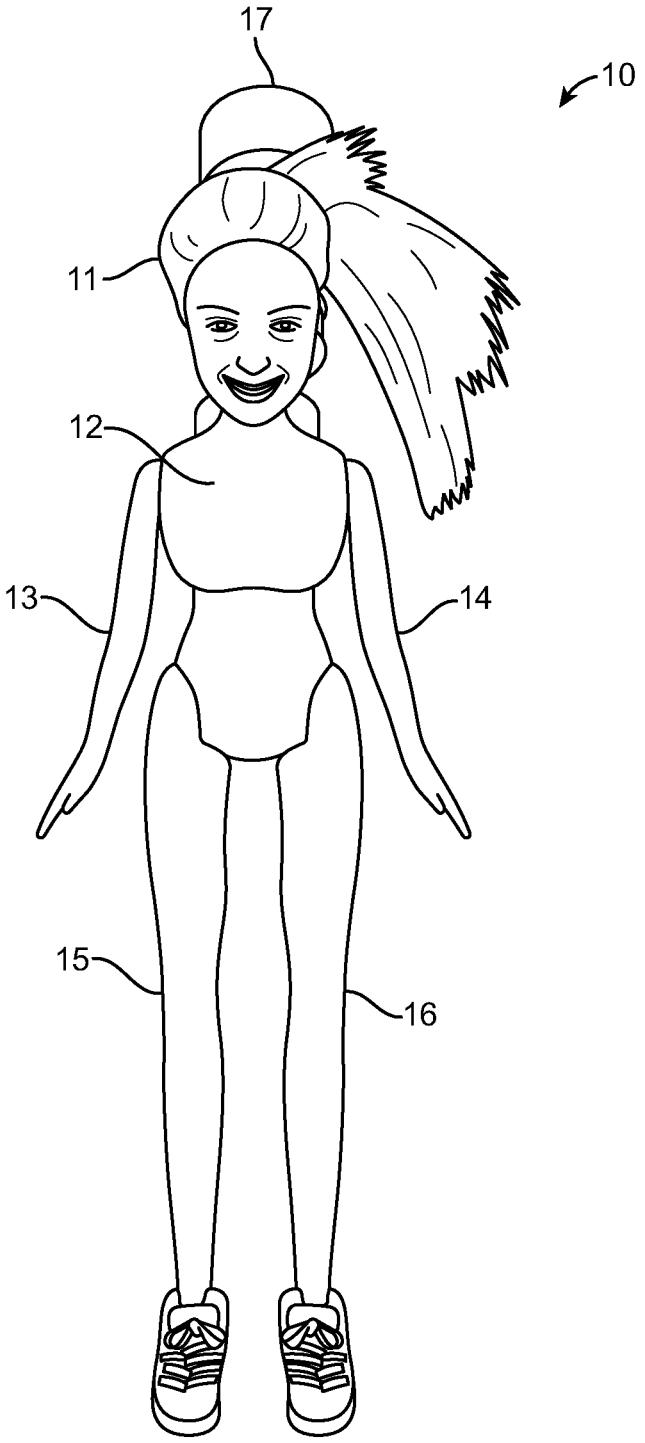
FIG. 1 is a non-limiting embodiment of a front view of the doll.

Turning to the figures, FIG. 1 illustrates a non-limiting embodiment of a front view of doll 10. Doll 10 has a head 11, torso 12, right arm 13, left arm 14, right leg 15, and left leg 16. A portion of the controller 17 is visible above the head 11.

Figure 2:
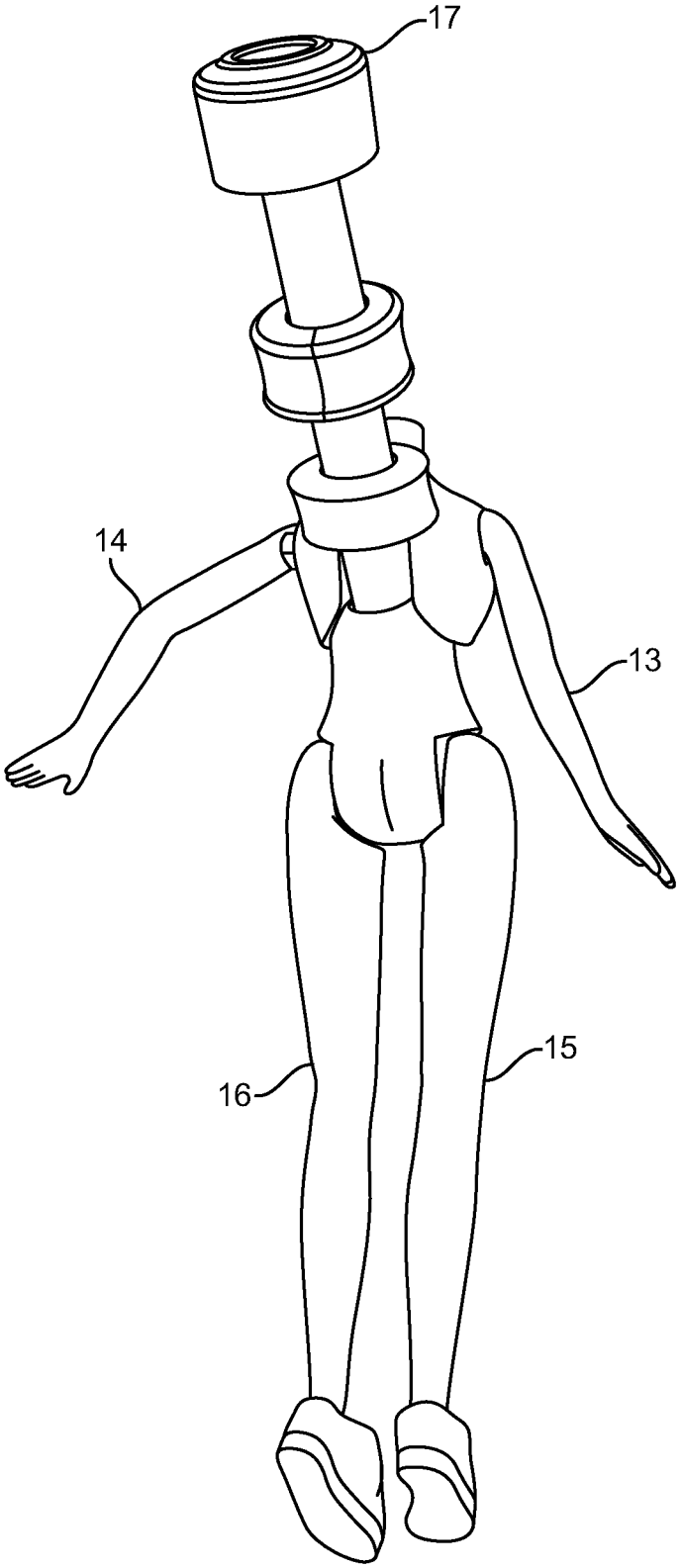
FIG. 2 is a non-limiting embodiment of a back view of the doll

FIG. 2 illustrates a non-limiting embodiment of a back view of doll 10.

Figure 3:
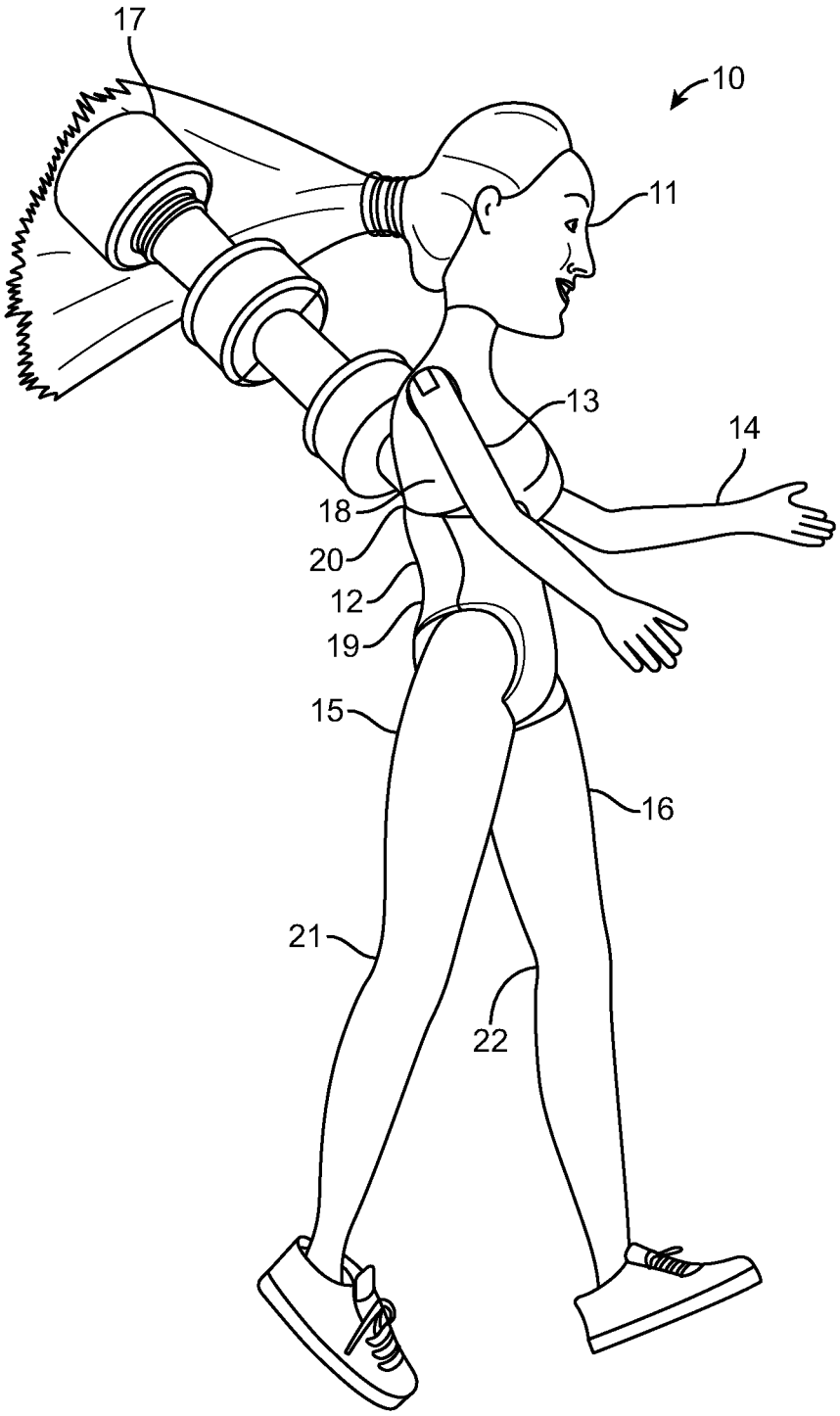
FIG. 3 is a non-limiting embodiment of a side view of the doll.

FIG. 3 illustrates a non-limiting embodiment of a side view of doll 10. In this embodiment, controller 17 is shown projecting from the back of doll 10. Also in this embodiment torso 12 has an upper portion 18 and a lower portion 19. The torso 12 has a rotation point 20 where upper portion 18 and lower portion 19 meet. The rotation point allows the lower body to rotate separate from the upper torso. Also in this embodiment, legs 15 and 16 are shown with hinge points 21 and 22. Hinge points 21 and 22 allow legs 15 and 16 to bend in a similar manner to knees. In one embodiment, hinge points 21 and 22 use a spring to affect the knee movement. In another embodiment, hinge points 21 and 22 use a hinge to affect the knee movement. In another embodiment, hinge points 21 and 22 use a flexible material to affect the knee movement. In another embodiment, hinge points 21 and 22 use a soft material to affect the knee movement. In another embodiment, hinge points 21 and 22 use a liquid material to affect the knee movement.

Figure 4:
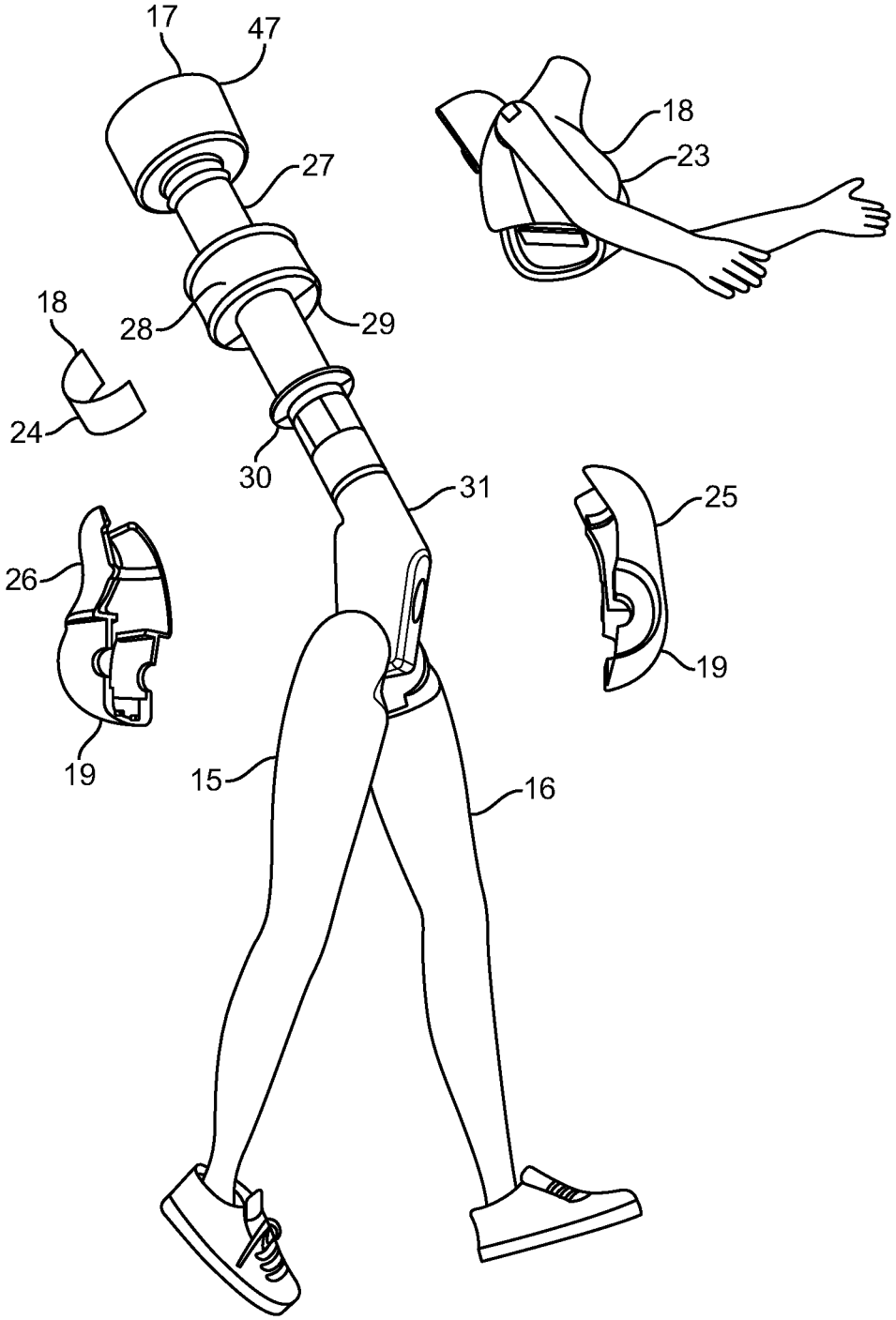
FIG. 4 is a non-limiting embodiment of a partially exploded side view of the doll.

FIG. 4 illustrates a non-limiting embodiment of a partially exploded side view of doll 10. In this embodiment, legs 15 and 16 are shown attached to controller 17. Also in this embodiment, upper torso 18 has a front piece 23 and a back piece 24. Also in this embodiment, lower torso 19 has a front piece 25 and a back piece 26. FIG. 3 also provides more detailed view of controller 17. In the embodiment shown, controller 17 has a handle 47 at one end, shaft 27, and at least two actuator buttons 28 and 29, a flange 30, and a leg gear box. In another embodiment, controller 17 has a handle 47 at one end, shaft 27, and at least four actuator buttons, a flange 30, an arm gear box, and a leg gear box. In the embodiment illustrated in FIG. 3, handle 47 is a circular knob shaped, however other shapes are also contemplated. Also in this embodiment, actuator buttons 28 and 29 partially wrap around shaft 27 and are each roughly half the shape of a hollow cylinder or doughnut, however other shapes are also contemplated.

Figure 5:
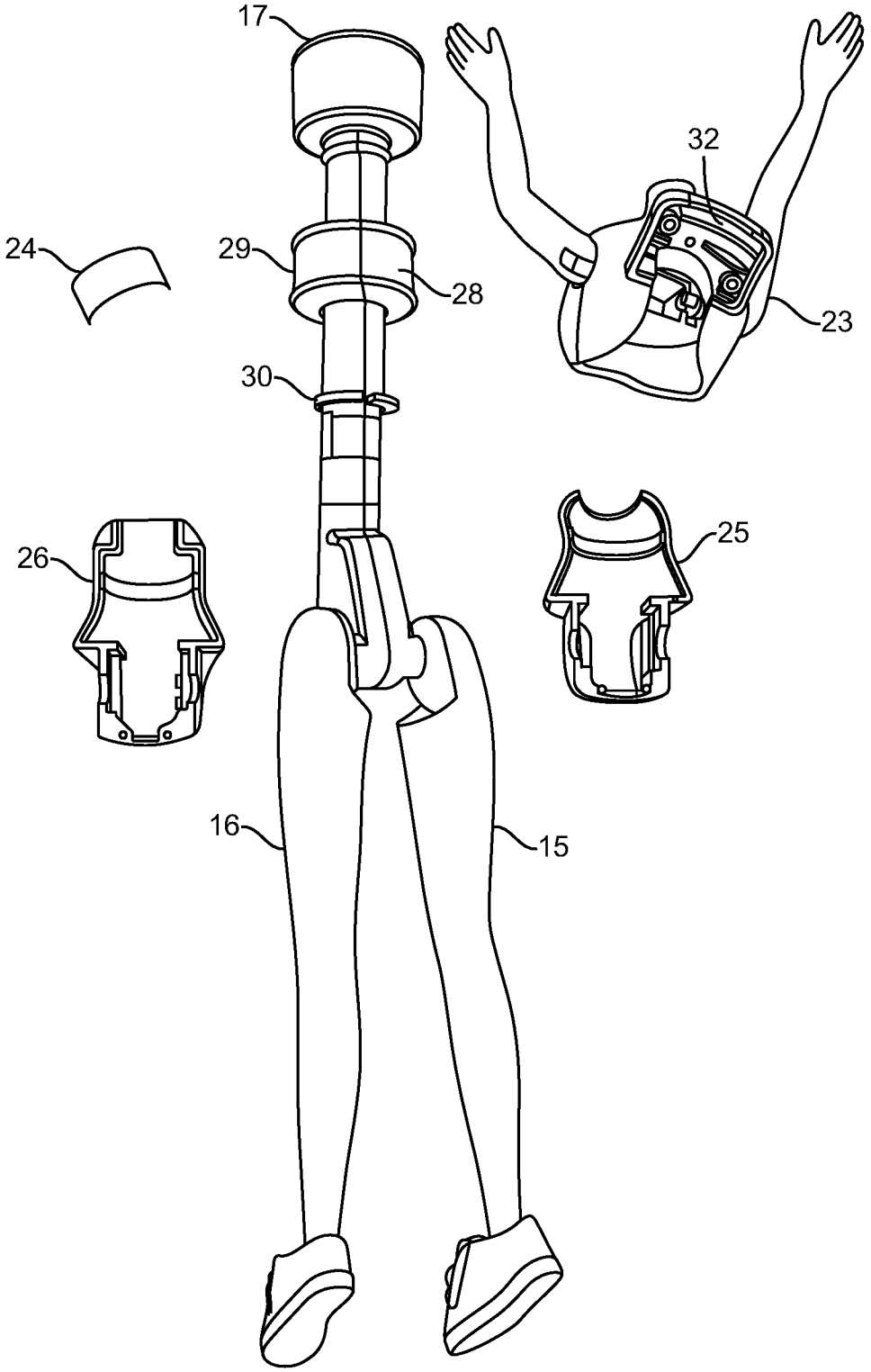
FIG. 5 is a non-limiting embodiment of a back view of parts of the doll.

FIG. 5 illustrates a non-limiting embodiment showing the interior surface of the torso pieces 23, 24, 25, and 26. In this embodiment, front piece of the upper torso 23 has an internal groove 32. Internal groove 32 aligns with flange 30 on shaft 27 of controller 17.

Figure 6:
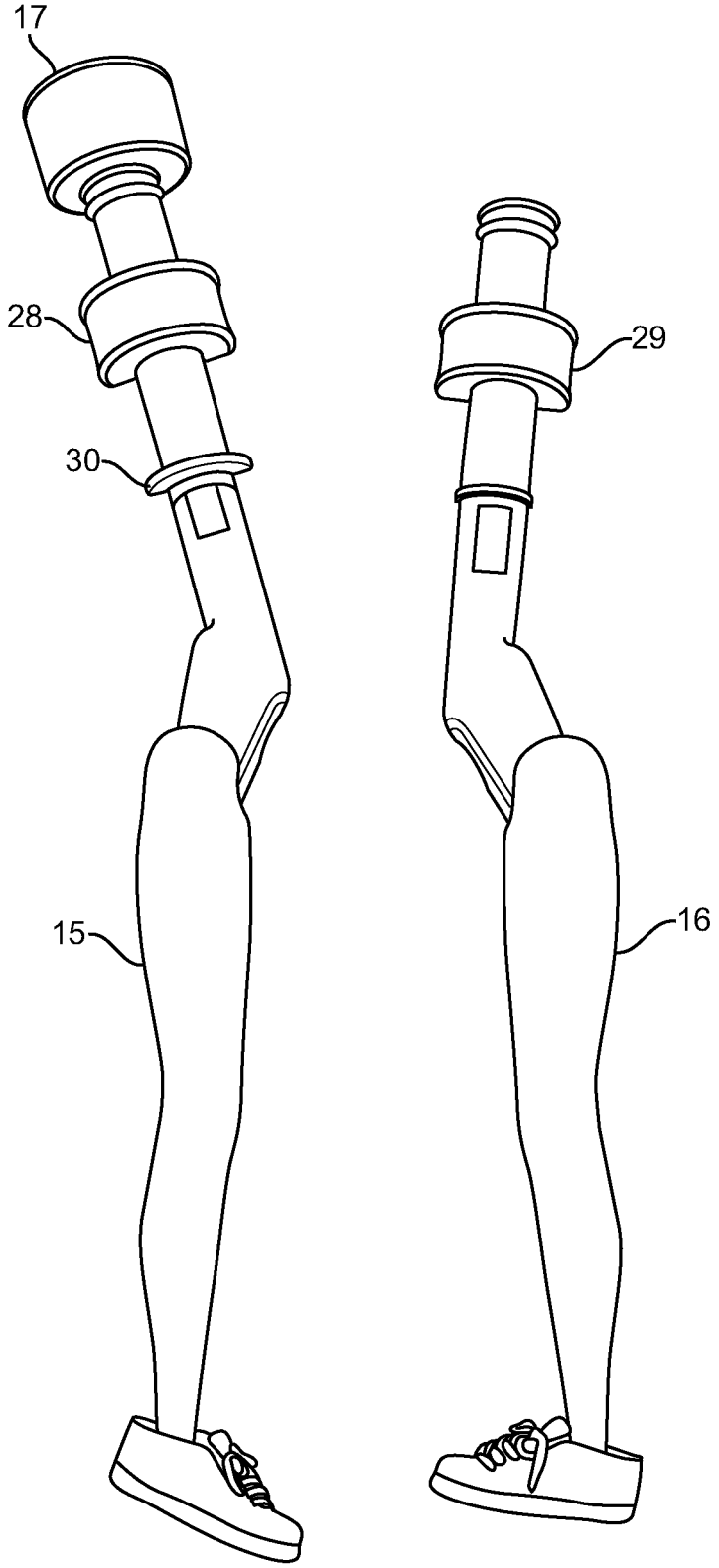
FIG. 6 is a non-limiting embodiment of an external section view of the leg gear mechanism.

FIG. 6 illustrates a non-limiting embodiment of the exterior view of the controller cut in half lengthwise with the legs still attached.

Figure 7:
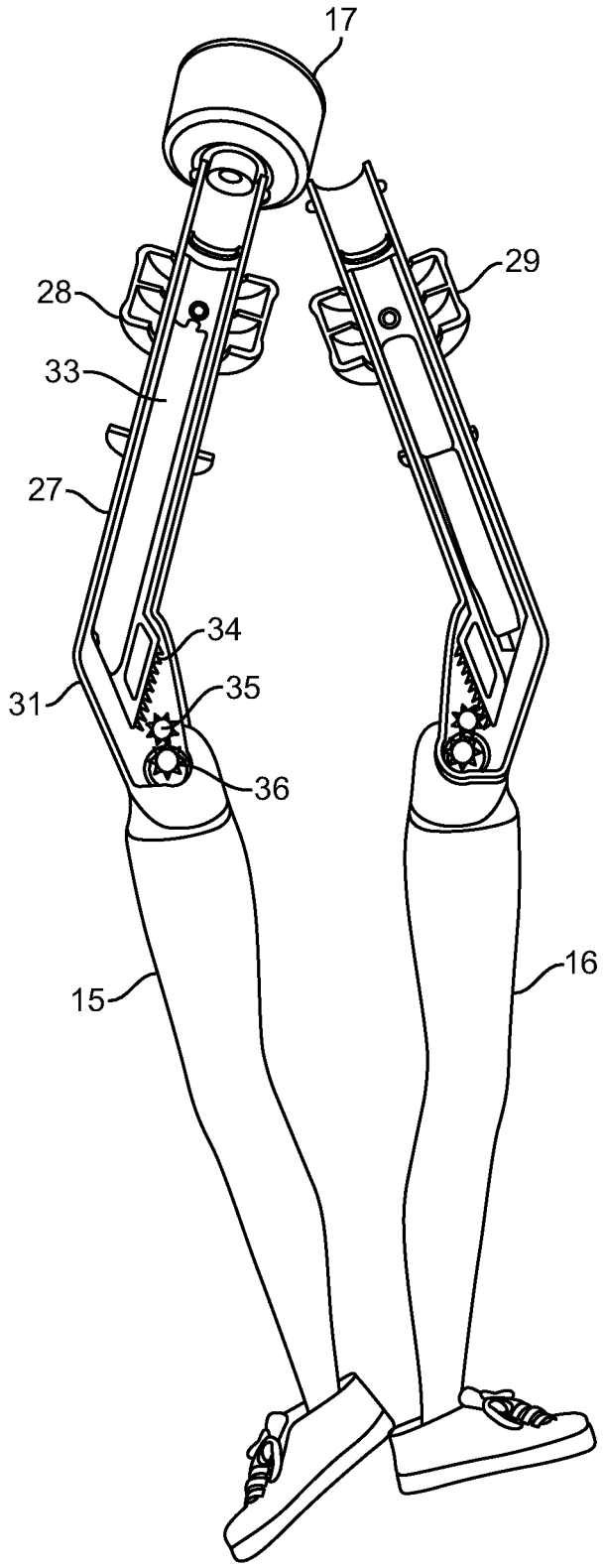
FIG. 7 is a non-limiting embodiment of an internal section view of the leg gear mechanism.

FIG. 7 illustrates a non-limiting embodiment of the interior view of controller 17 cut in half lengthwise with the legs still attached. In this embodiment, each half of controller 17 mirrors the other half in terms of the layout of the parts. Thus the parts in the right side of the controller are designed to move the right leg whereas the parts in the left side of the controller are designed to move the left leg. The left side parts and right side parts are fitted within their respective halves of the controller. In the embodiment shown in FIG. 7, first leg actuator 33 is attached at one end to actuator button 28. At the opposite end, first leg actuator 33 has a gear mesh section 34. Gear mesh section 34 meshes with a first gear 35. First gear 35 is illustrated as an external spur or straight cut gear, however, other types of external gears are contemplated. In the embodiment shown, gear mesh section 34 and first gear 35 form a rack and pinion type of movement, however alternative types of gearing are also contemplated. First gear 35 also meshes with second gear 36. Second gear 36 is illustrated as an external spur or straight cut gear, however, other types of external gears are contemplated. Second gear 36 is attached to a second leg actuator 37 (see FIGS. 9 and 10) that is embedded in the hip area of leg 15 such that movement of second gear 36 translates in movement of leg 15. The interaction of the actuators and gears allows a user to control movement of the leg through actuator button 28.

Figure 8:
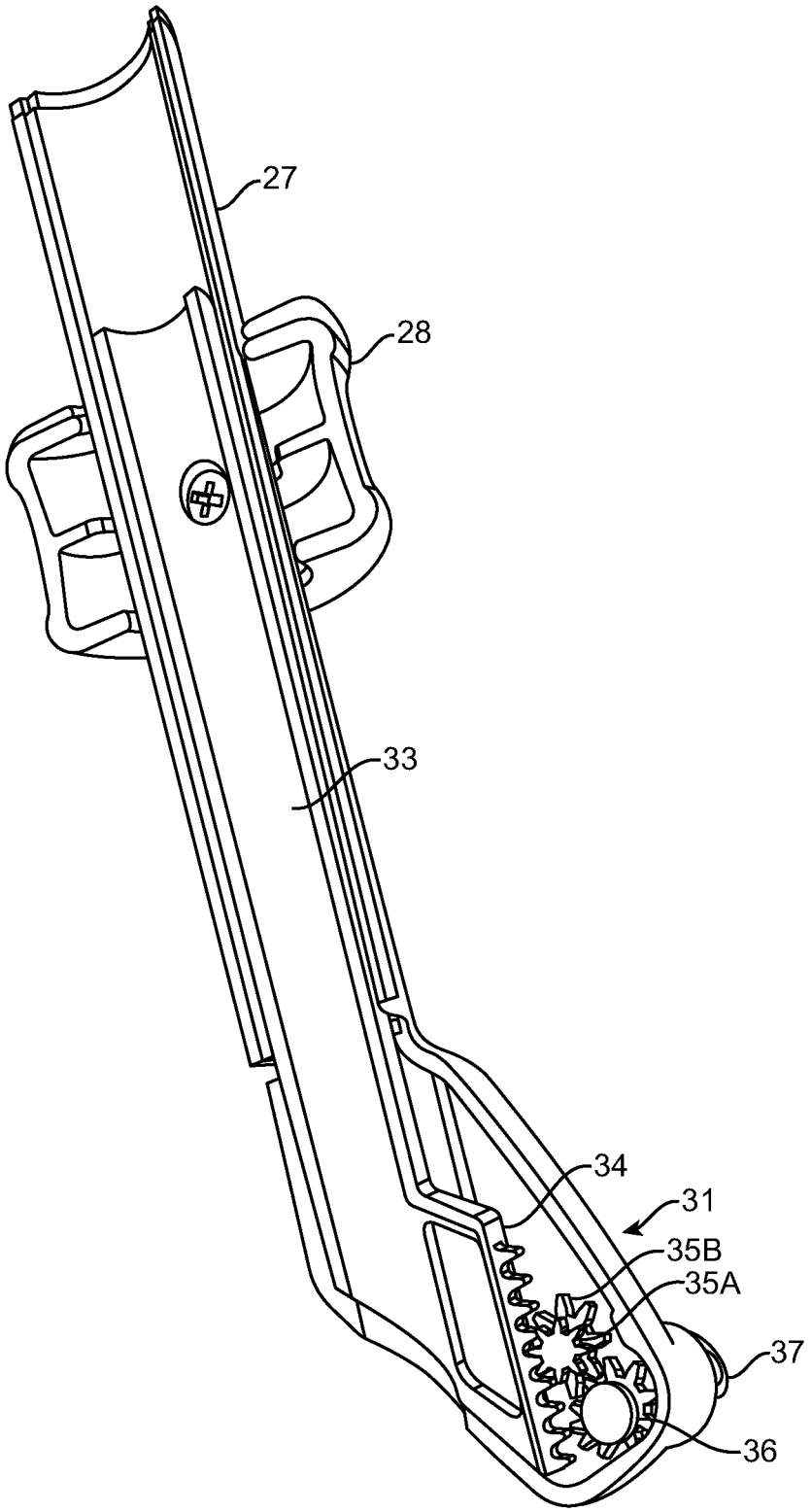
FIG. 8 is a non-limiting embodiment of an internal section view of the leg gear mechanism.
Figure 9:
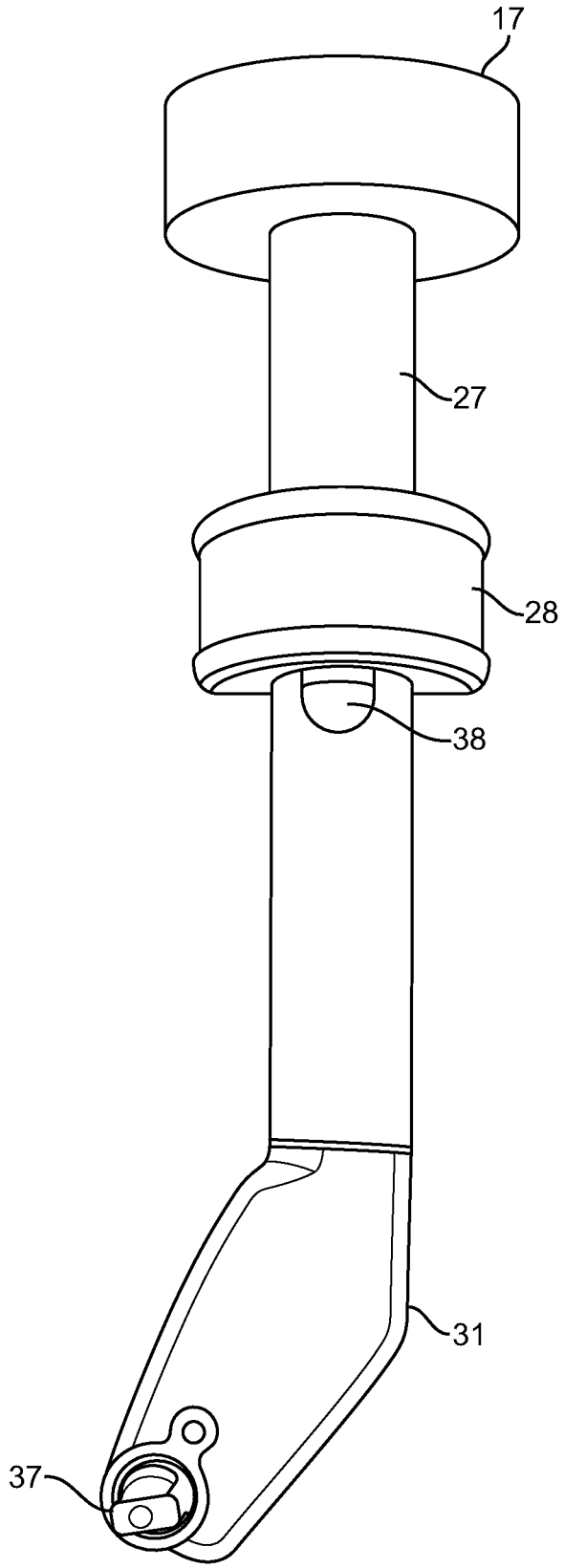
FIG. 9 is a non-limiting embodiment of an external section view of the leg gear mechanism.

FIGS. 8 and 9 illustrate non-limiting embodiments of an interior view and an exterior view, respectively of a controller and gear box. In this embodiment, the first gear 35 is two gears 35A and 35B stacked on top of each other. Alternatively, first gear 35 may be three or more gears stacked on top of each other. Having multiple gears may help with spacing with in the gear box cavity. Multiple gears can also be used to adjust the speed, range of motion, or amount of force needed to move the leg. When first gear 35 is made up of more than one gear, the individual gears may be the same size of different sizes. When first gear 35 is made up of more than one gear, the all the gears should turn together based on the movement of the gear that meshes with gear section 34. As illustrated in the figures, gear 35A meshes with gear mesh section 34 and gear 35B meshes with second gear 36. FIGS. 8 and 9 also illustrate a non-limiting embodiment of second leg actuator 37. Second leg actuator may be embedded into leg 15 or it may be fitted into a fitted receptacle located in leg 15, similar to male and female connectors.

Figure 10:
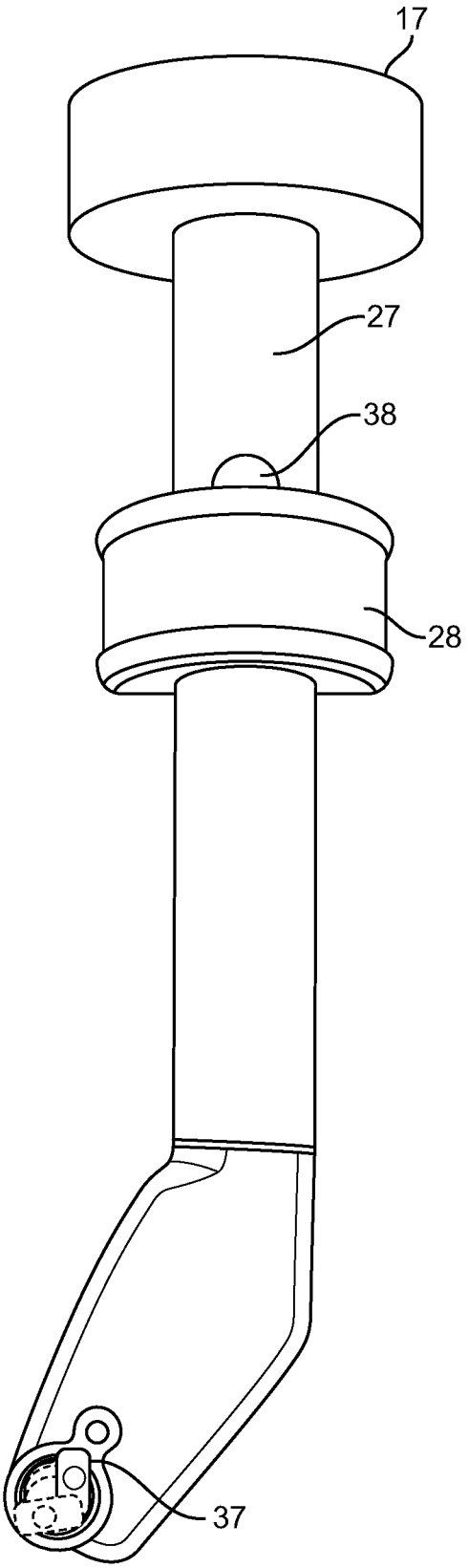
FIG. 10 is a non-limiting embodiment of an external section view of the leg gear mechanism.
Figure 11:
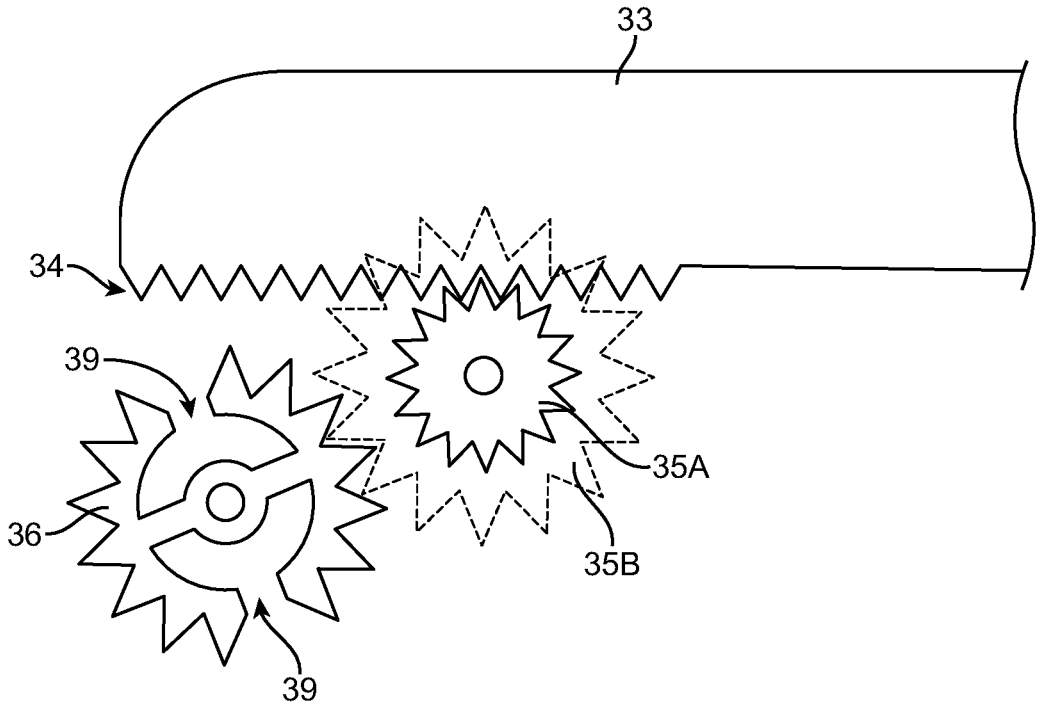
FIG. 11 is a non-limiting embodiment of a section view of a clutch gear.
Figure 12:
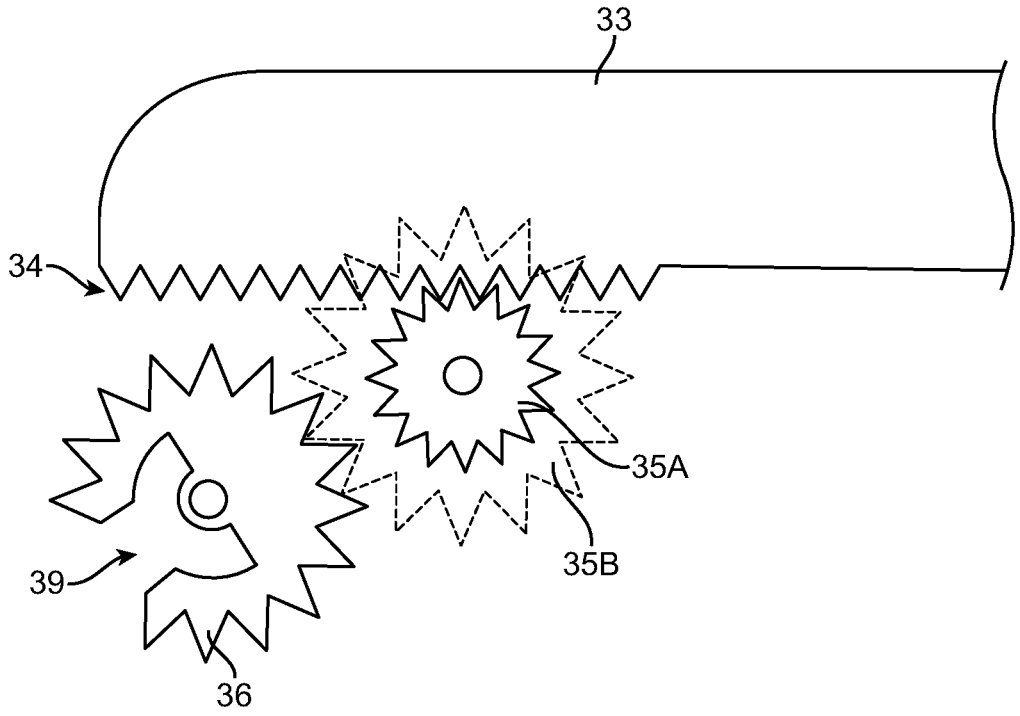
FIG. 12 is a non-limiting embodiment of a section view of a clutch gear.
Figure 13:
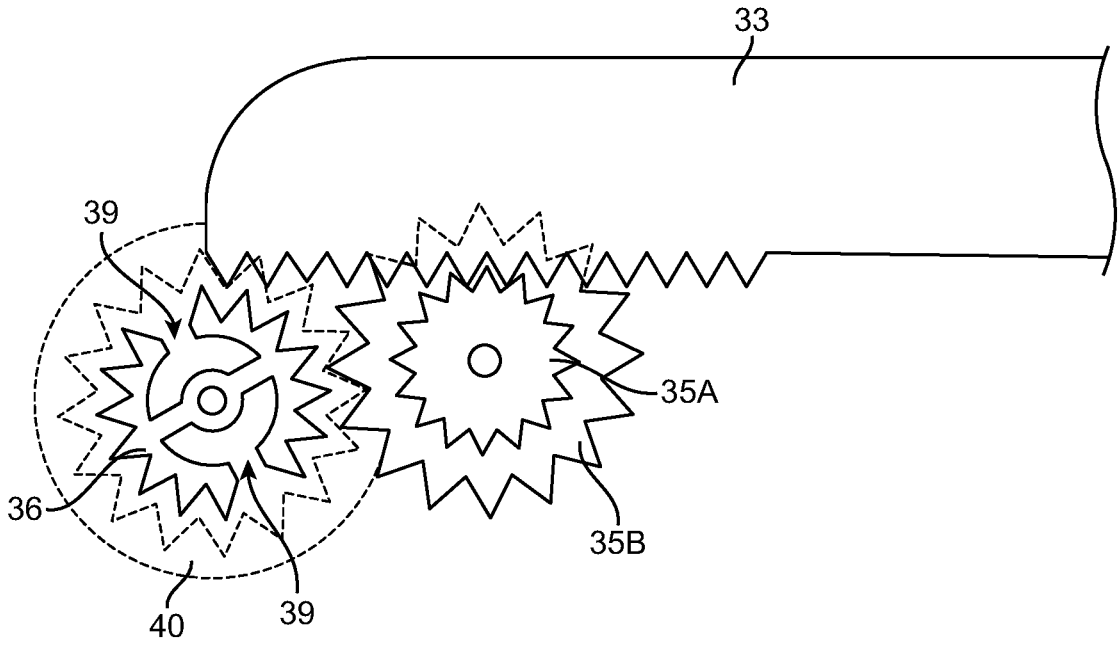
FIG. 13 is a non-limiting embodiment of a section view of a clutch gear.
Figure 14:
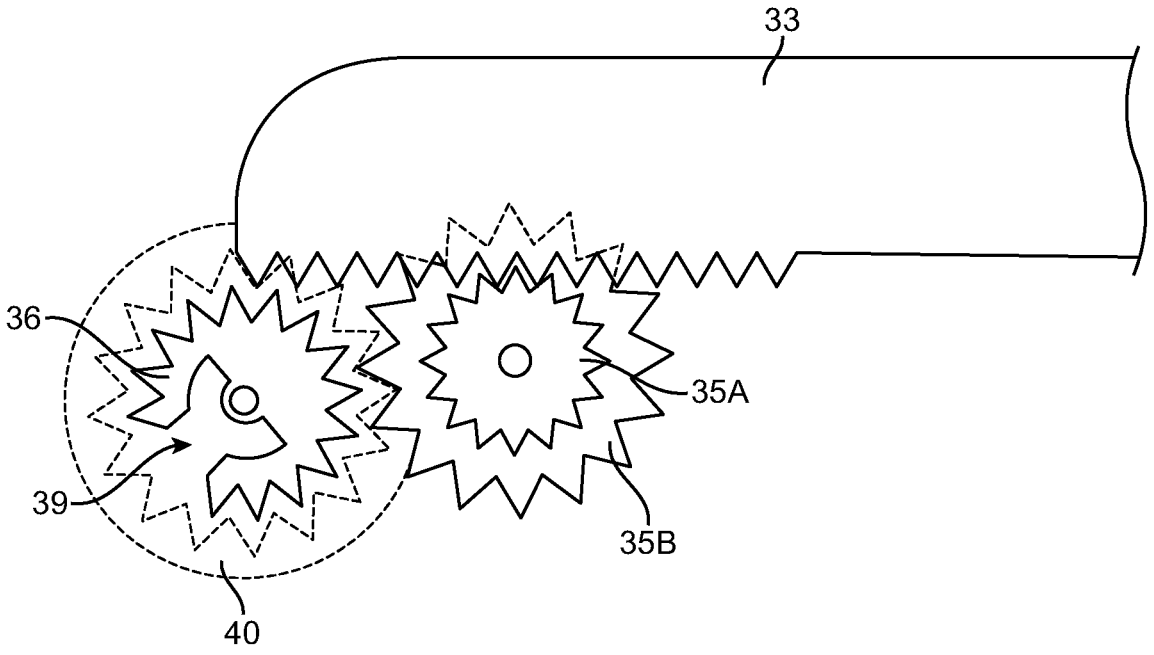
FIG. 14 is a non-limiting embodiment of a section view of a clutch gear.

FIGS. 9 and 10 illustrates a non-limiting embodiment of the movement of the actuator button 28 along shaft 27. Shaft 27 has a hole 38 to allow attachment of actuator button 28, which is located on the outside of shaft 27, to the first leg actuator 33, which is located inside shaft 27. Hole 38 should be long enough to allow the full range of motion of gear mesh section 34 against first gear 35.

FIGS. 11, 12, 13, and 14 illustrate non-limiting embodiments of clutch gearing system to prevent stripping of the gears when parts are moved under force. In these embodiments, second gear 36 has at least one open section 39. The open section allows the gears to "flex" and/or "skip" when under force. For example, if a user forcefully moves the leg in a full rotation. In the embodiments illustrated in 11 and 13, second gear 36 has two open sections whereas the embodiments illustrated in 12 and 14, second gear 36 has one open section. Second gear 36 having more than two open sections is also contemplated. Generally, when second gear 36 has more than one open section, the open sections are roughly equidistant from each other. In the embodiments illustrated in FIGS. 13 and 14, the clutch gearing system further includes a third gear 40 that also meshes with second gear 36. In these embodiments, second gear 36 may be either thick enough to engage with both first gear 35 and third gear 40 or alternatively, second gear 36 may be made up of two or more gears. As shown in the figures, third gear 40 is an internal gear.

Although the above controller and gear box has been described for use in manually controlling leg movement, it can also be adapted to control arm movement.

In another embodiment, controller 17 has two sets of actuator buttons, two sets of actuators, and two gear boxes. One set controls the legs and the second set controls the arms. In these embodiments, the set of actuator buttons that controls the arms may be located above or below the set of actuator buttons that controls the legs.

Figure 15:
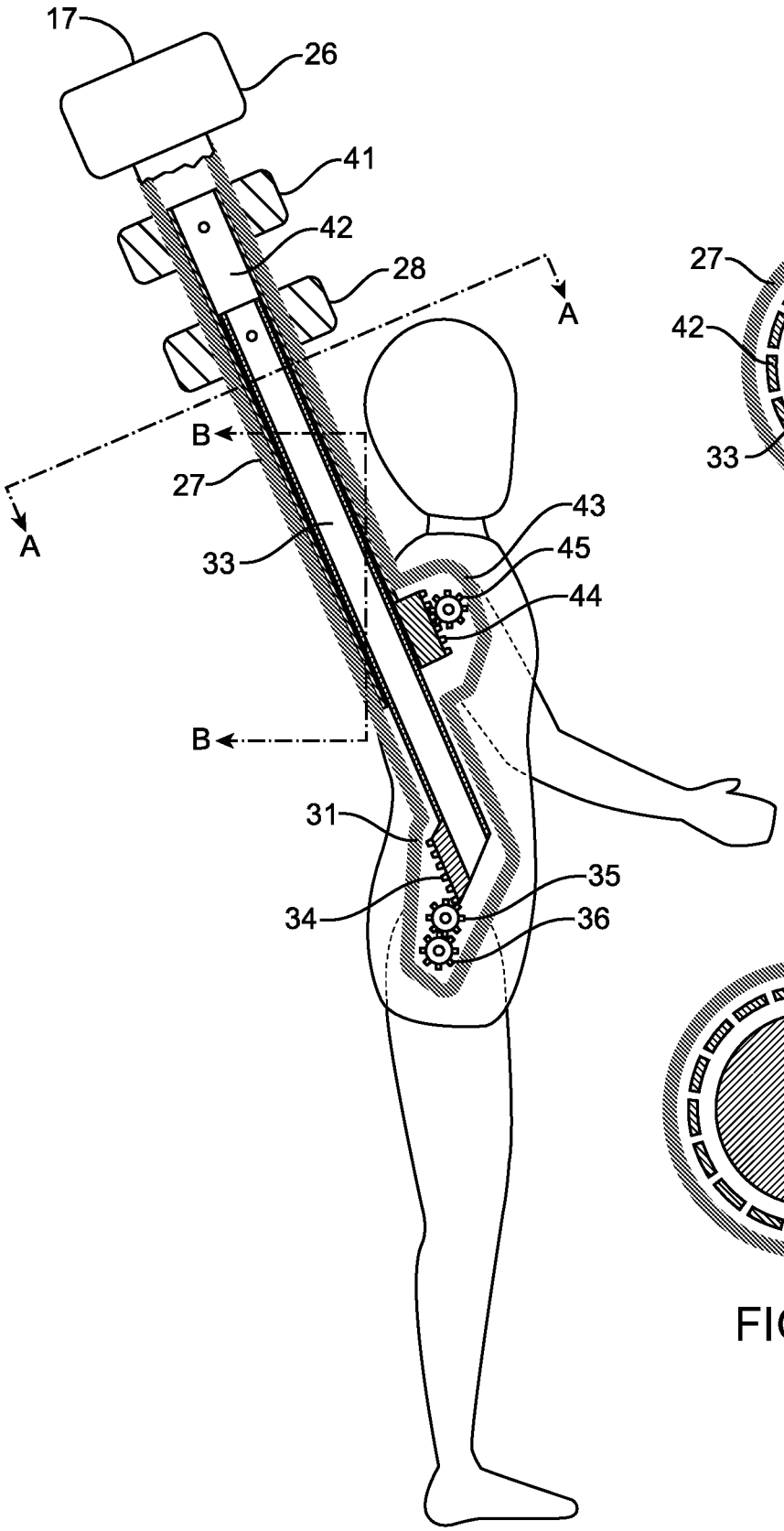
FIG. 15 is a non-limiting embodiment of a section view of the arm gear and leg gear.
Figure 16:
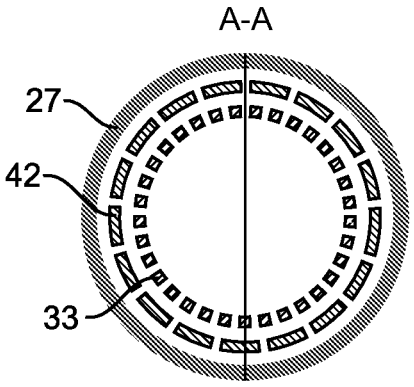
FIG. 16 is a non-limiting embodiment of a cross section view of the controller.
Figure 17:
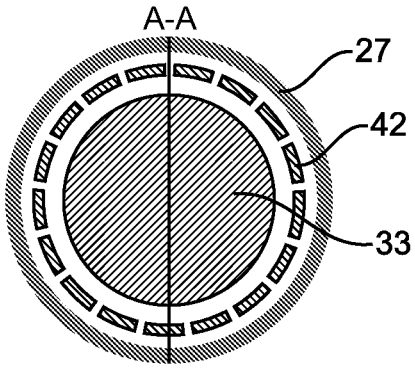
FIG. 17 is a non-limiting embodiment of a cross section view of the controller.

FIG. 15 illustrates a non-limiting embodiment of an action figure with the ability to manually manipulate both leg and arm action. In this embodiment, the controller 17 has two sets of buttons, two sets of actuators, and two sets of gear boxes; one set controls the arms and the other set controls the legs. In the embodiment shown, the upper set of buttons 41 control the arms and the lower set of buttons 28 control the legs. However, an embodiment having the upper set of buttons control the legs and the lower set of buttons control the arms is also contemplated. The cross-section illustration of FIG. 15 shows one half of each set, i.e. one arm button, one arm actuator, one arm gearbox, one leg button, one leg actuator, one leg gearbox; the other half of each set being a mirror image to the set shown. A shown, both button sets are located on the outside of the controller shaft 27 and both actuator sets are located on the inside of the controller shaft 27. In this embodiment, the actuators are nested together such that when both halves of the shaft are together, the parts form concentric circles (see FIGS. 16 and 17 which are a cross-section view taken from line A-A). In the embodiment shown in FIG. 16, the shaft and actuators form open circles whereas in the embedment shown in FIG. 17, the shaft and outer actuators form open circles and the inner actuators form a solid circle. The shape of the control shaft, arm actuator, and leg actuator has been illustrated as having a circular cross-section, however additional cross-section shapes such as square, rectangular, and polygonal are also contemplated.

Returning to the embodiment illustrated in FIG. 15, the controller shaft has two gear boxes positioned near the arms and legs of the doll. The leg control system (i.e. buttons, actuators, gear boxes, etc.) are as described above and labeled with the same element numbers. The arm control system (i.e. buttons, actuators, gear boxes, etc.) are set up in a similar manner to the leg system. Arm actuator 42 is attached at one end to an actuator button 41 and has a gear mesh section 44 at the other end. The gear mesh section 44 meshes with a first gear 45, which is attached to a second actuator (not shown) that is attached to or partially embedded in the arm. Movement of the button translates into movement of the arm. In one embodiment, additional gears may be used, e.g. up to three gears or up to five gears in series such that the first gear turns a second gear which turns a third gear and so on. In another embodiment, similar to the leg control system, first gear may be more than one gear to accommodate spacing needs or to adjust the speed, range of motion or forced need to move the arm. In another embodiment, the arm system can include the alternate gearing systems illustrated in FIGS. 11, 12, 13, and 14.

Figure 18:
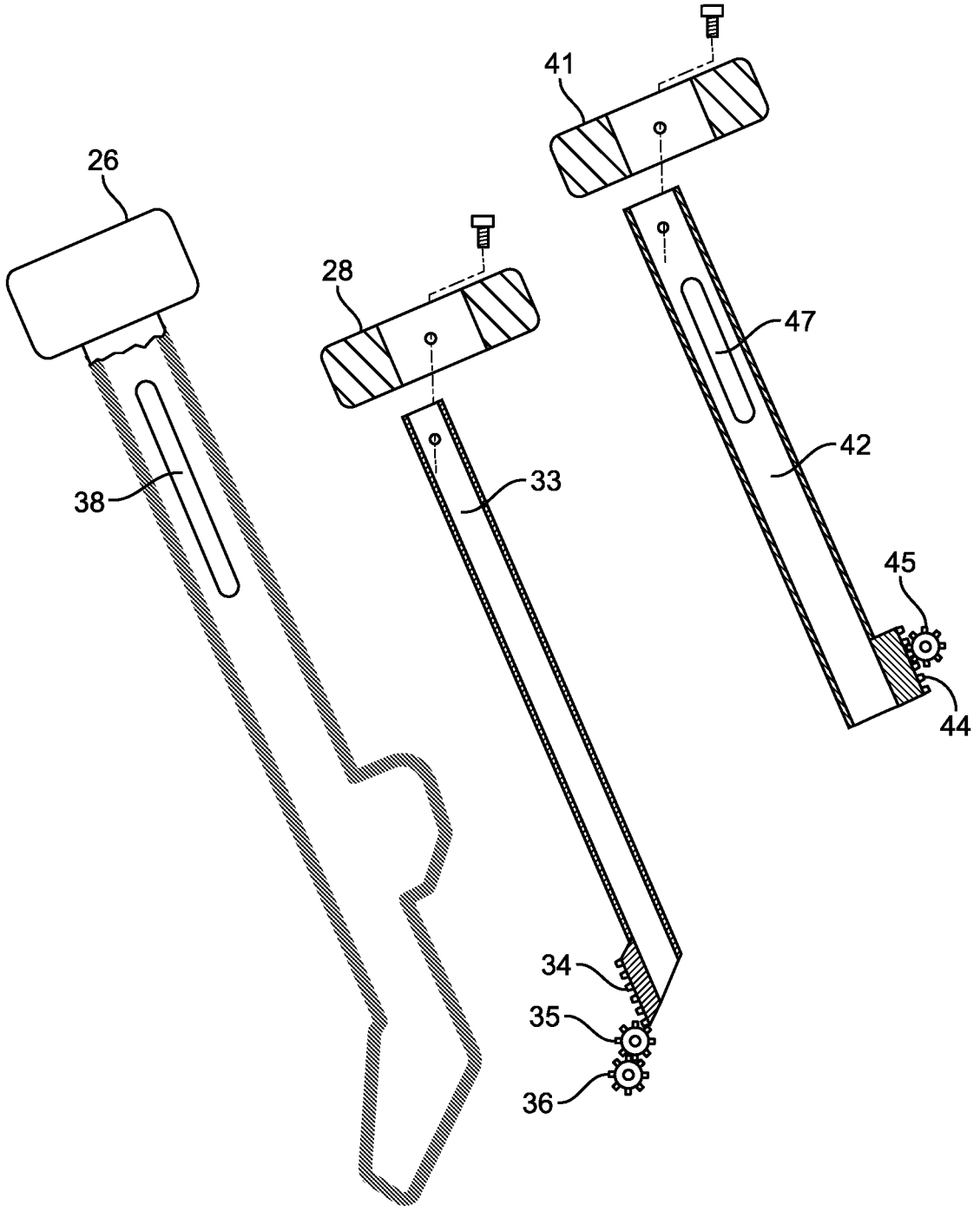
FIG. 18 is a non-limiting embodiment of a partially exploded view of the controller.

FIG. 18 illustrates a non-limiting embodiment of a partially exploded view of the controller 17 having both arm and leg control systems. In this view, the holes 38 and 47 allow buttons 28 and 41 to connect to actuators 33 and 42, respectively. Holes 38 and 47 should be sized to allow the full range of movement of actuators 33 and 42.

The internal portions of the controller may also include a lubricant. Use of a lubricant may reduce the friction that occurs from the individual pieces (e.g. actuators, gears, etc.) moving against each other. Non-limiting embodiments of lubricant include silicone, grease, petroleum based, mineral oils, vegetable oils, synthetic oils, powders, graphite, polytetrafluoroethylene, metal alloys, polymers, etc. In one embodiment, the lubricant is non-toxic for humans and/or animals.

Figure 19:
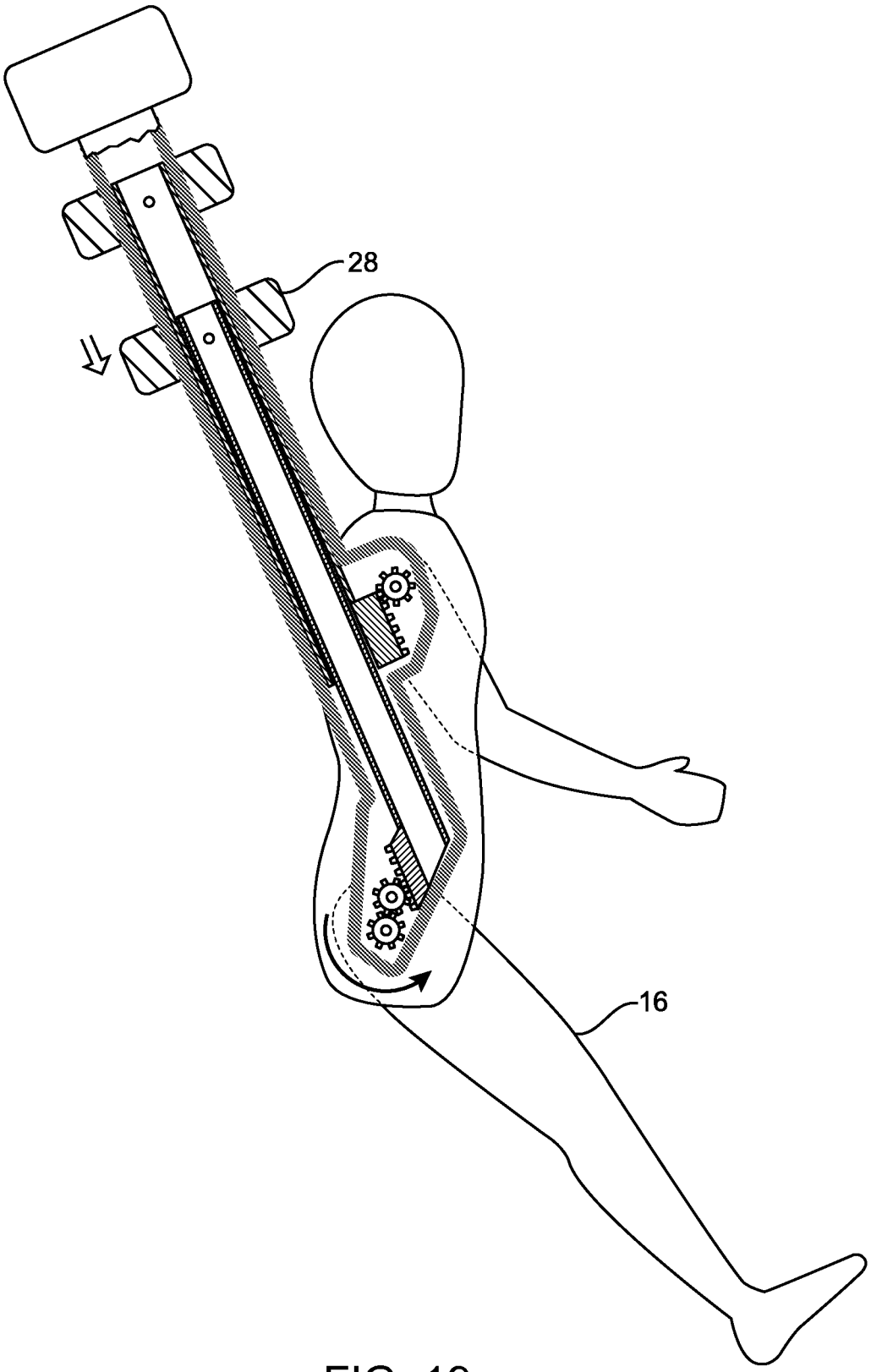
FIG. 19 is a non-limiting embodiment of an internal section view of the doll.
Figure 20:
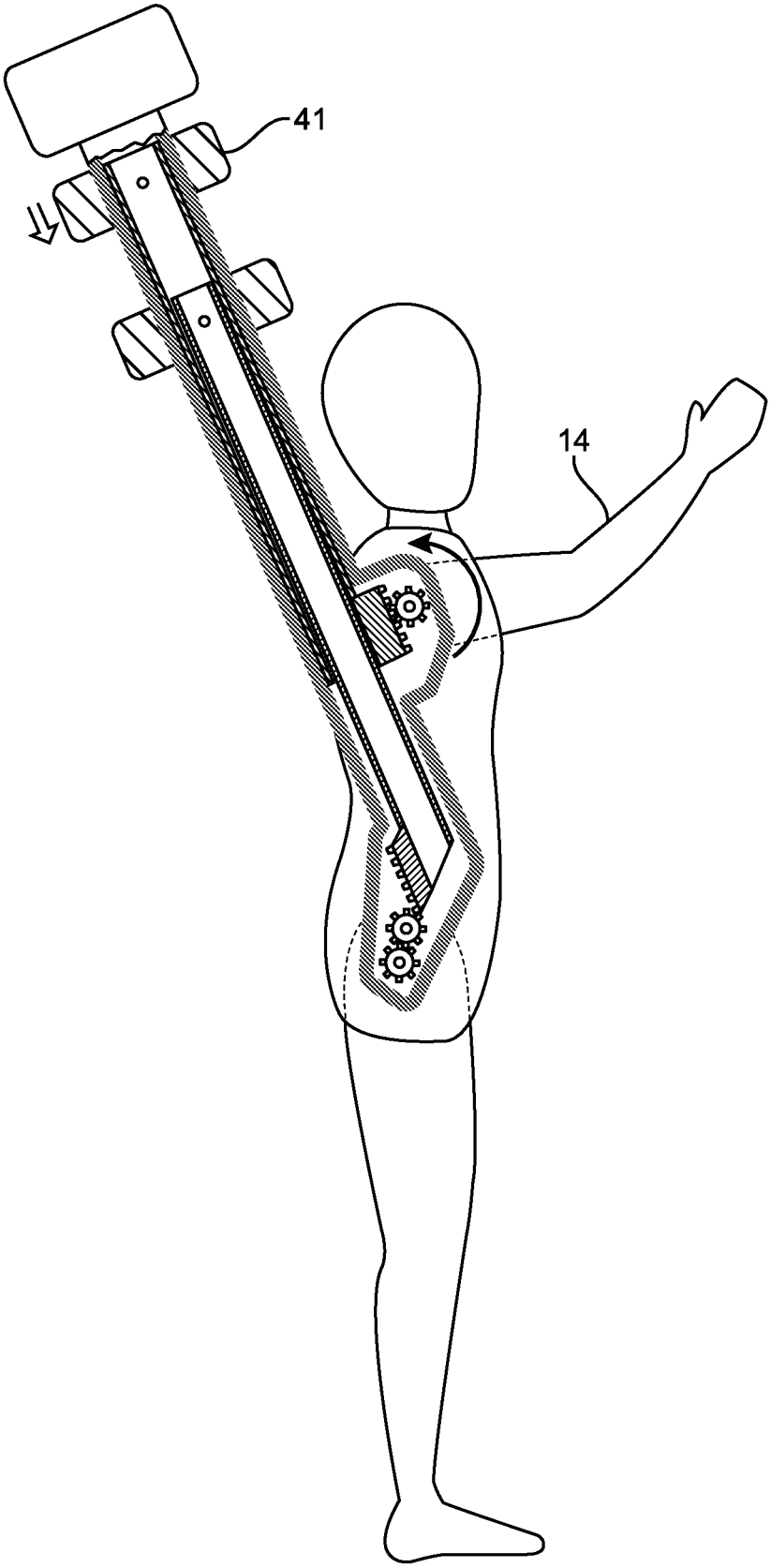
FIG. 20 is a non-limiting embodiment of an internal section view of the doll.
Figure 21:
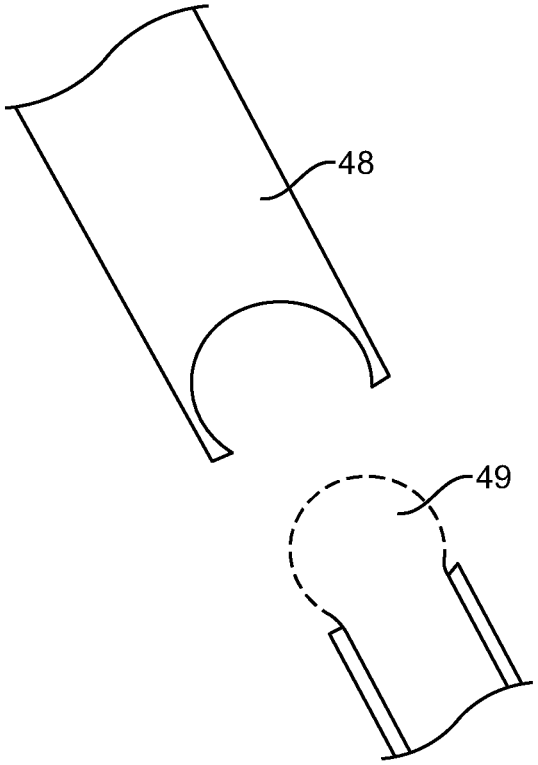
FIG. 21 is a non-limiting embodiment of a section view of a connector.
Figure 22:
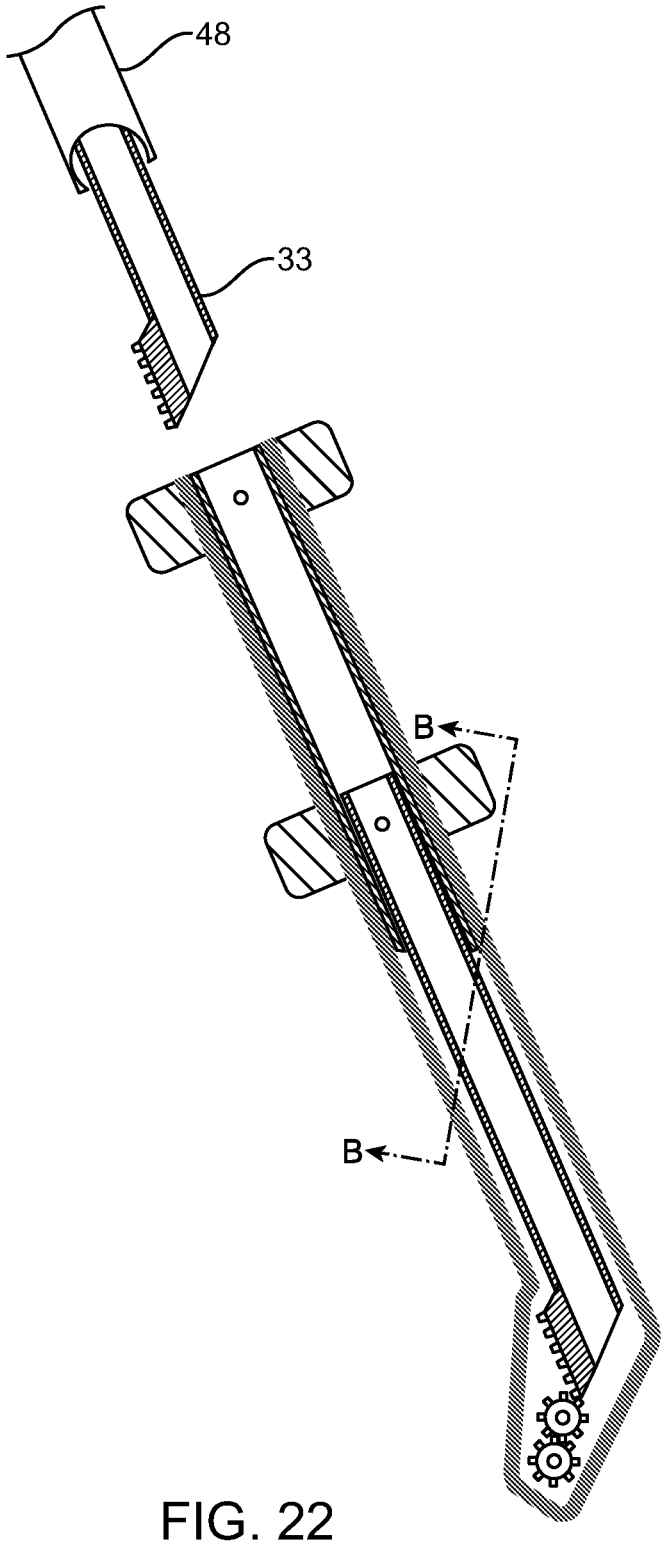
FIG. 22 is a non-limiting embodiment of a section view of a connector.
Figure 23:
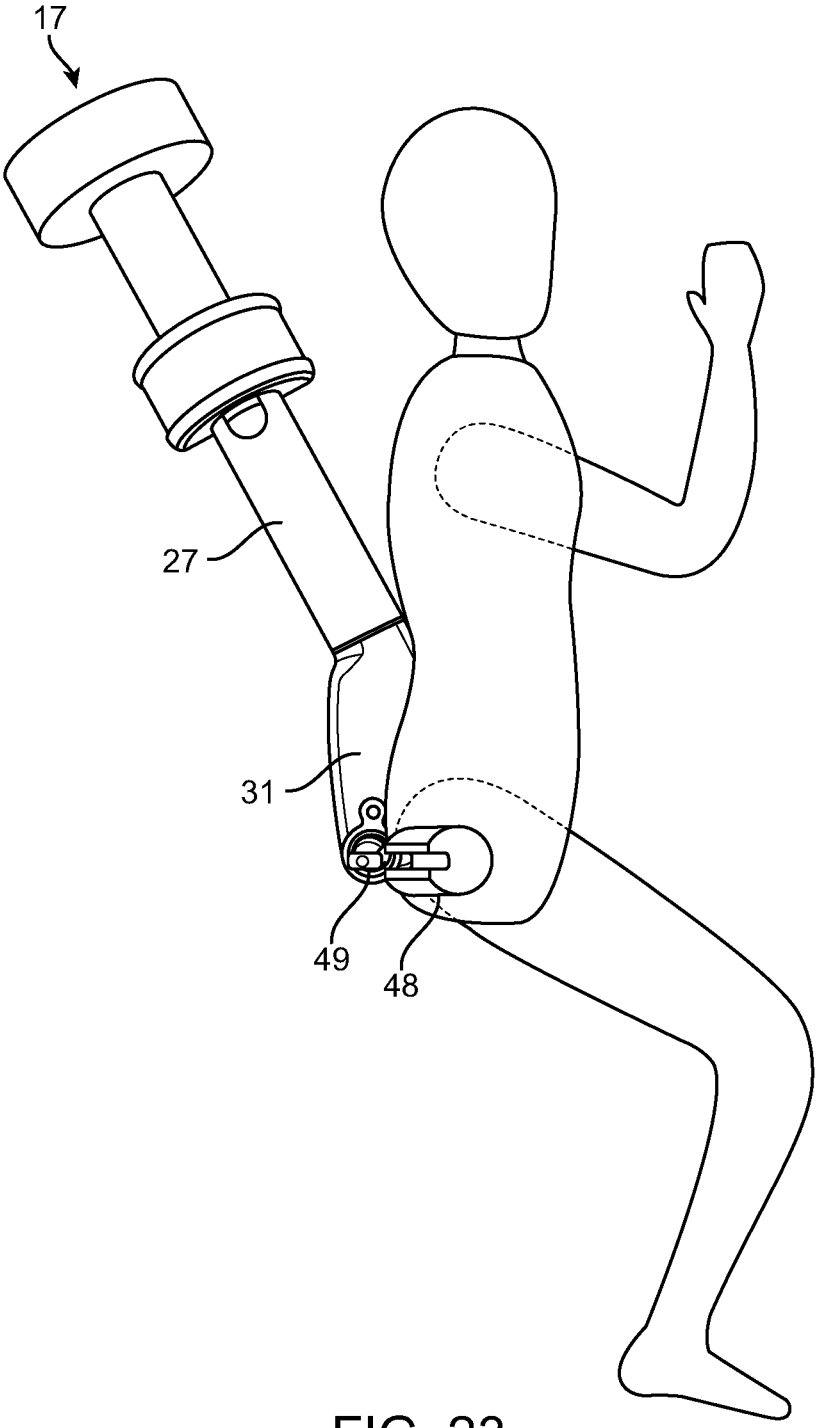
FIG. 23 is a non-limiting embodiment of a section view of a connector.

FIGS. 19 and 20 illustrate how movement of the buttons translates into movement of the doll's arms and legs. FIG. 19 shows that a downward movement of the leg button 28 translates into a forward movement of the doll's leg. FIG. 20 shows that a downward movement of the arm button 41 translates into a lifting movement of the doll's arm. In some embodiments, the direction of the doll's arm and/or leg movement can be altered through the use of additional gears. For example, adding a second gear to the arm gear box would reverse the direction of the arm movement. Same is true for the leg gear box. Alternatively, in another embodiment, the direction of the doll's arm and/or leg movement can be altered by changing the direction of the button movement. For example, moving the button in an upward movement would reverse the direction of the arm movement.

FIGS. 15, 21, 22, and 23 illustrate a non-limiting embodiment of a removable controller. In these embodiments, controller 17 may be detached from the doll. Detachment may occur in a number of different ways. In one embodiment illustrated in FIGS. 15 and 22, detachment of the shaft and actuators occurs at a point above the gear box(es) as depicted by line B-B. In this embodiment, it may be beneficial to have a mechanism to help reconnect the actuators such as male 48 and female 49 connectors or the like as illustrated in the non-limiting embodiment of FIG. 21. In another embodiment illustrated in FIG. 22, the detachment of the shaft may occur at a point above the gear box(es), however, the actuator(s) stays intact and is/are removed from the gear box(es). This embodiment may also incorporate male/female connectors. In yet another embodiment illustrated in FIG. 23, the entire controller and gear box are removed. For simplicity, FIG. 23 only illustrates controller having a leg gear box, however, this same mechanism could be used in embodiments having both arm and leg gear boxes. In this embodiment, the second leg actuators (e.g. 37) and/or the second arm actuators could pop out of the leg and/or arm and may use male/female couplers to do so. This embodiment may also require an alternative means for holding the torso pieces together once the controller was removed. For example, the torso could be one or two solid pieces with hollowed out portions designed to hold the controller when attached to the doll. Also contemplated for all the removable controller embodiments, is an additional piece that can be used to cover or fill in a space when the controller has been removed.

In general, the controller 17, actuator buttons, actuators, gear box, and gears may be made from a number of different materials. Non-limiting materials include: plastic, polymers, rubber, nylon, metals, alloys, composites, and the like. In one embodiment, the material is non-toxic for humans and/or animals.

To manipulate the arms and/or legs, a user grasps the handle 47 and uses the thumb and finger tips to move the buttons. Alternatively, the user may use both hands to move the arm and leg buttons.

The disclosure set forth above is provided to give those of ordinary skill in the art a complete disclosure and description of how to make and use embodiments of the controller and doll, and are not intended to limit the scope of what the inventors regard as their invention. Modifications of the above-described modes (for carrying out the invention that are obvious to persons of skill in the art) are intended to be within the scope of the following claims. All publications, patents and patent applications cited in this specification are incorporated herein by reference as if each such publication, patent or patent application were specifically and individually indicated to be incorporated herein by reference.

What is claimed is:

1. A controller for manipulating a doll comprising:

a handle;

a hollow shaft having a first end, a second end, an outside, an inside, a first hole, and a second hole;

a first button;

a second button;

a hollow first actuator received within the hollow shaft, the hollow first actuator having a first end and a second end, wherein the first end of the first actuator is attached to the first button and the second end of the first actuator comprises a gear mesh section;

a second actuator received within the hollow first actuator, the second actuator having a first end and a second end, wherein the first end of the second actuator is attached to the second button and the second end of the second actuator comprises a gear mesh section; and a first gear box having a first gear set comprising at least one collapsible gear having an open section passing therethrough permitting the gear to flex under force and a third actuator and a second gear set comprising at least one collapsible gear having an open section passing therethrough permitting the gear to flex under force and a fourth actuator;

wherein the handle is connected to the first end of the hollow shaft and the first gear box is connected to the second end of the hollow shaft;

wherein the first button and the second button are located on the outside of the hollow shaft and the first actuator and the second actuator are located inside the hollow shaft and wherein the first button and the second button are attached to the first actuator and the second actuator using the first hole and the second hole;

wherein the gear mesh section of the first actuator meshes with the at least one gear in the first gear set and wherein the gear mesh section of the second actuator meshes with the at least one gear in the second gear set;

wherein the doll comprises a head, a first arm, a second arm, a first leg, a second leg, and a torso;

wherein the third actuator actuates an arm movement or a leg movement on the doll and wherein the fourth actuator actuates an arm movement or a leg movement on the doll.

2. The controller of claim 1, further comprising:

a third button;

a fourth button;

a fifth actuator having a first end and a second end, wherein the first end of the first actuator is attached to the third button and the second end of the first actuator comprises a gear mesh section;

a sixth actuator having a first end and a second end, wherein the first end of the second actuator is attached to the fourth button and the second end of the second actuator comprises a gear mesh section;

a second gear box having a third gear set comprising at least one gear and a seventh actuator and a fourth gear set comprising at least one gear and an eighth actuator;

wherein the third button and the fourth button are located on the outside of the shaft and the fifth actuator and the sixth actuator are located inside the shaft;

wherein the gear mesh section of the fifth actuator meshes with the at least one gear in the third gear set and wherein the gear mesh section of the sixth actuator meshes with the at least one gear in the fourth gear set; and wherein the seventh actuator actuates an arm movement or a leg movement on the doll and wherein the eighth actuator actuates an arm movement or a leg movement on the doll.

3. The controller of claim 2, wherein at least one gear in the third gear set has an open section passing therethrough permitting the gear to flex under force; and wherein at least one gear in the fourth gear set has an open section passing therethrough permitting the gear to flex under force.

4. The controller of claim 2, wherein at least one gear in the third gear set contains at least two open sections; and wherein the at least one gear in the fourth gear set contains at least two open sections.

5. The controller of claim 4, wherein the at least two open sections on the at least one gear in the third gear set and the at least two open sections on the at least one gear in the fourth gear set are circumferentially equidistant.

6. The controller of claim 2, wherein the first gear box and the second gear box are located in the torso portion of the doll.

7. The controller of claim 2, wherein the third actuator actuates movement of the first arm; wherein the fourth actuator actuates movement of the second arm; wherein the seventh actuator actuates movement of the first leg; and wherein the eight actuator actuates movement of the second leg.

8. The controller of claim 2, wherein the third actuator actuates movement of the first leg; wherein the fourth actuator actuates movement of the second leg; wherein the seventh actuator actuates movement of the first arm; and wherein the eight actuator actuates movement of the second arm.

9. The controller of claim 1, wherein the first gear set further comprises at least two gears; and wherein the second gear set further comprises at least two gears.

10. The controller of claim 1, wherein the first gear set further comprises at least three gears; and wherein the second gear set further comprises at least three gears.

11. The controller of claim 1, wherein at least one gear in the first gear set contains at least two open sections passing therethrough permitting the gear to flex under force; and wherein the at least one gear in the second gear set contains at least two open sections passing therethrough permitting the gear to flex under force.

12. The controller of claim 11, wherein the at least two open sections on the at least one gear in the first gear set and the at least two open sections on the at least one gear in the second gear set are circumferentially equidistant.

13. The controller of claim 1, wherein the first gear box is located in the torso portion of the doll.

14. The controller of claim 1, wherein the third actuator actuates movement of the first arm and wherein the fourth actuator actuates movement of the second arm.

15. The controller of claim 1, wherein the third actuator actuates movement of the first leg and wherein the fourth actuator actuates movement of the second leg.

16. The controller of claim 1, wherein the controller further comprises the ability to detach and re-attach to the doll.

17. The controller of claim 16, wherein the controller detaches at a point above the first gear box and/or the second gear box.

18. The controller of claim 1, wherein the torso comprises an upper portion and a lower portion, and wherein the torso further comprises a rotation point where the upper and lower portions of the torso meet.

19. The controller of claim 18, wherein the torso has an internal groove that mates with a flange on the hollow shaft of the controller.

* * * * *